United States Patent [19]

Owada et al.

[11] Patent Number: 5,047,809

[45] Date of Patent: Sep. 10, 1991

[54] FIXING APPARATUS WITH OIL SUPPLY APPARATUS

[75] Inventors: Akihiro Owada; Yoshikazu Ikunami, both of Tokyo, Japan

[73] Assignee: Konica Corporation, Tokyo, Japan

[21] Appl. No.: 301,287

[22] Filed: Jan. 25, 1989

[30] Foreign Application Priority Data

| | | | |
|---|---|---|---|
| Jan. 26, 1988 | [JP] | Japan | 63-16542 |
| Jan. 26, 1988 | [JP] | Japan | 63-16543 |
| Mar. 9, 1988 | [JP] | Japan | 63-56707 |

[51] Int. Cl.[5] ..... G03G 15/20

[52] U.S. Cl. ..... 355/284; 118/60; 219/216; 355/283

[58] Field of Search ..... 118/60; 423/60; 355/283, 284, 289, 290; 219/469, 216

[56] References Cited

U.S. PATENT DOCUMENTS

| | | | |
|---|---|---|---|
| 3,810,776 | 5/1974 | Banks et al. | 118/60 X |
| 4,086,871 | 5/1978 | Rydeen et al. | 432/60 X |
| 4,149,485 | 4/1979 | Okamoto et al. | 432/60 X |
| 4,359,963 | 11/1982 | Saito et al. | 118/60 |
| 4,393,804 | 7/1983 | Nygard et al. | 118/60 |
| 4,568,275 | 2/1986 | Sakurai | 219/216 X |
| 4,692,022 | 9/1987 | Iwai | 355/319 X |

FOREIGN PATENT DOCUMENTS 0026974 2/1985 Japan .

*Primary Examiner*—A. T. Grimley
*Assistant Examiner*—Robert Beatty
*Attorney, Agent, or Firm*—Finnegan, Henderson, Farabow, Garrett, and Dunner

[57] ABSTRACT

This invention relates to a fixing apparatus where a toner image is formed on a transfer medium by passing the transfer medium between a heat roller and a press roller, each of the rollers rotating while in pressure contact with each other. An oil application roller is disposed in pressure contact with and is driven by the heat roller. The oil application roller has a layer of heat-resistant fibers on its circumferential surface. An oil-impregnated member is pressed against the oil application roller through a pressure contact surface formed of a non-woven cloth for transferring oil having a dynamic viscosity of $\nu 2$ in the range of 1,000 cst to 10,000 cst, to the oil application roller. The oil application roller is continuously supplied with oil from the oil-impregnated fiber member and the cloth and supplies oil having a dynamic viscosity of $\nu 1$, to the circumferential surface of the heat roller during rotation. The ratio of dynamic viscosities of the oils being in the range of $\nu 2:\nu 1 = 1:3$ to 30. The amount of oil applied to the transfer medium is substantially equal to the amount of oil transferred from the oil-impregnated member to the oil application roller and is substantially equal to $3.5 \times 10^{-2}$ mg/100 cm$^2$ to 0.11 mg/100 cm$^2$.

8 Claims, 5 Drawing Sheets

FIXING APPARATUS WITH OIL SUPPLY APPARATUS

BACKGROUND OF THE INVENTION

1. Field of the Invention

This invention relates to a fixing apparatus for heating and fixing toner images on a transfer medium such as recording paper, and more specifically to a fixing apparatus applicable to such image producing equipment as electrophotographic copying machines and laser recording equipment and in which a transfer medium or recording paper with toner image on it is fed between a heat roller and a press roller, both in pressure contact with each other and rotating together, to fix the toner image.

The invention also relates to a copying machine with a paper feeding apparatus which feeds, one by one, the lowermost sheet of stacked recording papers with toner images fixed, and more specifically to an oil application apparatus in the copying machine which applies oil to the surface of the recording paper when the transferred image is fixed on the recording paper surface.

2. Description of the Prior Art

In recent years, a growing number of copying machines are using a document circulation apparatus to enable making fast plural copies of documents. The document circulation apparatus separates one sheet at a time from the stacked documents on a stacker, automatically feeds them onto the platen glass of the copying machine, and, after exposure processing, returns them to the stacker. This entire process is repeated.

In one processing cycle, the document circulation apparatus generates one set of copies, one copy for each sheet of the document. Thus, the documents are circulated the same number of times as the number of copies taken. Such an apparatus usually employs a "bottom-feed, return -to-top" system as a technique for separating and feeding each of the stacked documents. In this technique, the lowermost sheet of the document on the stacker is separated one at a time and fed to the image processing section and the exposed sheets are returned successively onto the top of the stacked document on the stacker. This process is repeated a required number of times.

Various types of automatic two-side copying machines have been proposed which automatically record the document images not only on one side of the recording paper but also on the other side. In such automatic two-side copying machines, the image processing section copies a document image on one side of the recording paper, and the copied paper is temporarily stacked on an intermediate stacker in the equipment and then again fed to the image processing section.

A plurality of recording paper sheets with document images copied on one side are stacked on a tray of the intermediate stacker, with the image side facing up. When the document feeding is started again, a pressing plate is lowered to press the stacked recording paper and at the same time a feed roll is rotated to feed the bundle of the recording papers toward a multiple feed prevention means, where the lowermost sheet of the stacked paper is separated by frictional action and again fed to the image processing section.

The bottom-feeding technique in which the lowermost sheet of the document or recording paper is separated and fed one by one is generally accomplished by a multiple feed prevention means which consists of a feed belt and a stop roller pressing against the feed belt to produce friction, which is used for sheet separation.

In the above document circulation apparatus, the documents are repetitively circulated through a series of processes, so that there are possibilities of the documents being folded, chipped away or wrinkled. And there are cases where important documents are torn. As a counter- measure, it is widely practiced that a copy is first taken and that this copy is used as a second document instead of the document and then stacked on the stacker for further processing. In the afore-mentioned "bottom-feed, return-to-top" method, however, there is a problem that since the toner-fixed surface of the lowermost sheet of the second document and the back of the second lowermost sheet are strongly pressed against each other, excess friction is produced resulting in the toner being scaled off and smearing the second document.

Also in the two-side copying there is a similar problem. That is, the recording paper sheet at the bottom of the stacked papers on the intermediate stacker is separated and fed one sheet at a time by the action of friction, so that toner is removed by excess friction, smearing the paper, as in the case where the second document is used.

SUMMARY OF THE INVENTION

This invention has been accomplished to eliminate the abovementioned drawbacks. An object of this invention is to provide a fixing apparatus which reduces friction between the sheets of the second document to prevent scaling off of the toner due to excess friction and therefore smearing of the second document so that a good image quality of the copies can be obtained. This object can be attained by a fixing apparatus in which a transfer medium with a toner image formed thereon is passed between a heat roller and a press roller, both rotating while in pressure contact with each other, to fix the toner image on the transfer medium, comprising: an oil application roller in pressure contact with and driven by the heat roller, the oil application roller having a layer of heat-resistant fibers on the circumferential surface; and an oil supply means containing an oil-impregnated fiber member, the oil supply means having non-woven cloth to form a pressure contact surface through which the oil-impregnated fiber member is pressed against the oil application roller; whereby the oil application roller is continuously supplied with oil from the oil supply means and the oil application roller applies oil to the circumferential surface of the heat roller as it is rotated by the heat roller.

The above objective can be also achieved by a fixing apparatus in which a transfer medium with a toner image formed thereon is passed between a heat roller and a press roller, both rotating while in pressure contact with each other, to fix the toner image on the transfer medium, comprising: an oil application roller in pressure contact with and driven by the heat roller, the oil application roller having a layer of heat-resistant fibers on the circumferential surface, the layer of heat-resistant fibers being impregnated with oil 1 with dynamic viscosity of $\nu 1$; and an oil supply means having a fiber member impregnated with oil 2 with dynamic viscosity of $\nu 2$, the oil-impregnated fiber member being pressed against the oil application roller; whereby the ratio of dynamic viscosities of oil 2 and oil 1 is set at $v2:v1 = 1:3$ to 30.

Another object of this invention is to provide a fixing apparatus which reduces friction between the sheets of the second document or between the recording paper sheets with an image copied on one side to prevent scaling off of toner due to excess friction and therefore smearing of the second document or the recording paper with both sides copied so that a good image quality of the copies can be obtained.

In a copying machine with a feeding apparatus, in which a recording paper with toner image transferred and fixed on its surface, is stacked on a stacker and then the lowermost sheet of the stacked recording papers is fed one by one. The above objective can be achieved by an oil application apparatus which applies oil to a heat roller of a fixing apparatus in the copying machine. The amount of oil applied to the recording paper during the fixing process being set at $3.5 \times 10^{-2}$mg/100cm$^2$ to 0.11mg/100cm$^2$.

DETAILED DESCRIPTION OF THE PREFERRED EMBODIMENT

Figure 5:
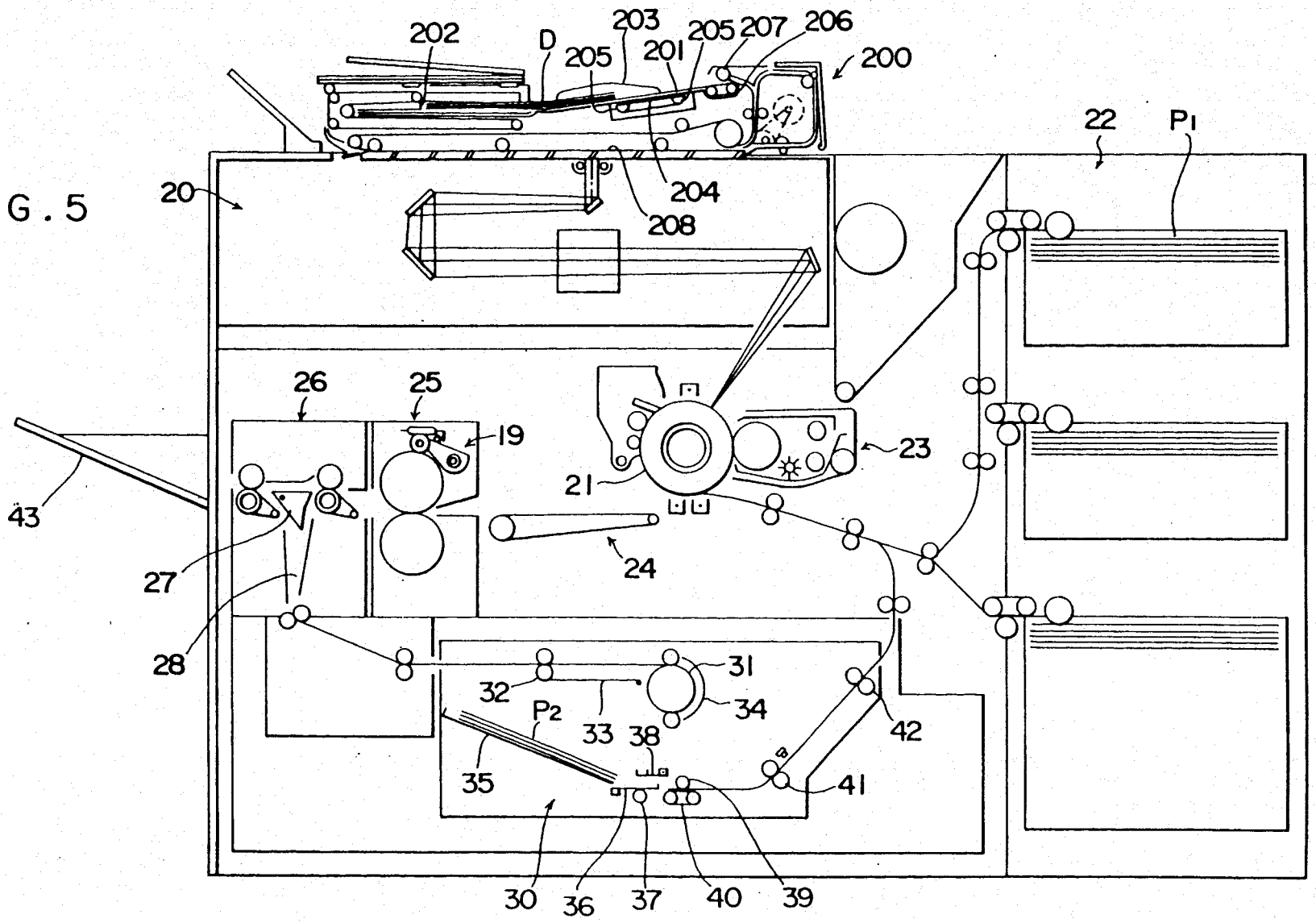
FIG. 5 is a cross section of a reproducing apparatus to which this invention is applied.

A copying machine or reproducing apparatus shown in FIG. 5 has a document feeder 200 of circulation type and a inverting section 30 for two-side copying. Referring to the construction of the reproducing apparatus, we will describe the process of feeding documents and recording papers.

For protection of the document, a copy of the document is made through a first copying operation and is used as a second document, which is circulated through the equipment.

The second documents obtained by the first copying operation (simply referred to as documents D) are stacked on a stacker 201 with an image-formed surface facing up. At this time, the rear end of the documents D are placed in contact with a rear end guide plate 202 to align the front and rear ends of the documents. Then the lateral alignment of the documents is made by a side guide plate 203. The number of copies to be made is entered and a copy button is pressed. Then the rear end guide plate 202. moves forward pushing the rear end of the document D until the document D is placed on a push belt 204. Next, as semi-circular rollers 205 rotate to drive the push belt 204, the document D is fed by the push belt 204 which moves slightly projecting above the document mounting level of the stacker 201. The document is pushed forward to a nip formed between a paper feed belt 206 and a stop roller 207. At this time the paper feed belt 206 is at rest, so that as soon as the document enters into the nip between the paper feed belt 206 and the stop roller 207, the document D stops there with the lower sheets of the document fed farther than the upper sheet, the plurality of sheets being in the shape of a wedge.

Then, the paper feed belt 206 rotates in the paper feeding direction. At this time since the stop roller 207 in contact with the paper feed belt 206 is kept in a non-turning state, the lowermost sheet of the document D is taken and fed by the paper feed belt 206 and the succeeding sheets are blocked by the stop roller 207 from being fed, thus preventing a multiple sheet feeding.

The single sheet of the document D, which has been separated from the remaining sheets as a result of the frictional separating operation performed by a combined action of the paper feed belt 206 and the stop roller 207, is now exposed by an optical system 20 on a platen glass 208 to form a document image on the surface of an image retainer 21.

Recording paper Pl contained in a cassette or tray in a paper supply section 22 for one-side copying is fed one sheet at a time by a selected paper feed means. In an image formation section 23, the document image on the image retainer 21 is transferred onto the recording paper Pl. The recording paper P2 with the image copied on one side is then carried by a transfer belt of a transfer section 24 to a fixing apparatus 25 where it is heated to fix the image on the paper. At the same time an oil application apparatus 19 of this invention installed in the fixing apparatus 25 applies oil to the surface of the recording paper P2 on which the image has been fixed. When the recording paper P2 is to be copied also on the other side, an inversion/discharge selector section 26 provided downstream of the fixing apparatus 25 is switched to a downward path that leads the recording paper P2 toward the inverting section 30.

When the recording paper P2 is to be not copied on the other side, the inversion/discharge selector section 26 is switched to the paper discharge side to discharge the recording paper P2 onto a tray 43. The second document D mentioned above may use this copy with the image on only one side.

The recording paper P2 is then introduced by a movable distribution member 27, shaped like an inverse triangle in cross section, into a reversion path 28, through which it is supplied to the inverting section 30. The paper P2 supplied to the inverting section 30 is clamped between and carried by an endless belt 33—which travels between a large-diameter pulley 31 and a small-diameter pulley 32—and a group of follower rollers pressing against the outer surface of the endless belt 33. In the process the paper P2 is inverted by an inverting guide 34 as it passes the guide. The inverted recording paper P2 is fed onto a stacker 35 with the image surface facing up, and slides down the upper surface of the stacker 35 to be stacked at the lower part thereof.

Provided at the lower end of the inclined stacker 35 is a retractable front end guide member 36, which has a recording paper abutting surface with which the front end of the recording paper P2 comes into contact for front end alignment. The recording paper P2 slides down the inclined surface of the stacker 35 by air flow or its own weight and stops when its lower end contacts the abutting surface of the front end guide member 36.

In this way, the recording paper P2 with an image copied on one side is stacked on the stacker 35.

When the back side copying is to be started, a first paper feed roller 37, a separation belt 40, a second paper feed roller 41 and a paper discharge roller 42 are driven. The recording paper P2, which is stacked on the guide surface of the front end guide member 36 and pressed from above by a pressing member 38 for alignment, is carried by the first paper feed roller 37 and the separation belt 40 to a pressure contact point between a multiple feeding prevention roller 39—which is stationary—and the rotating separation belt 40, where it is clamped between them and, by the frictional separation action, only the lowermost sheet of the recording papers P2 is separated and fed to an image formation section 23.

In the image formation section 23, the recording paper P2 is copied with a document image on the back side and the copied image is fixed by the fixing apparatus 25, after which the copied paper is discharged through the inversion/discharge selector section 26 out onto the tray 43 attached outside the copying machine.

Figure 1:
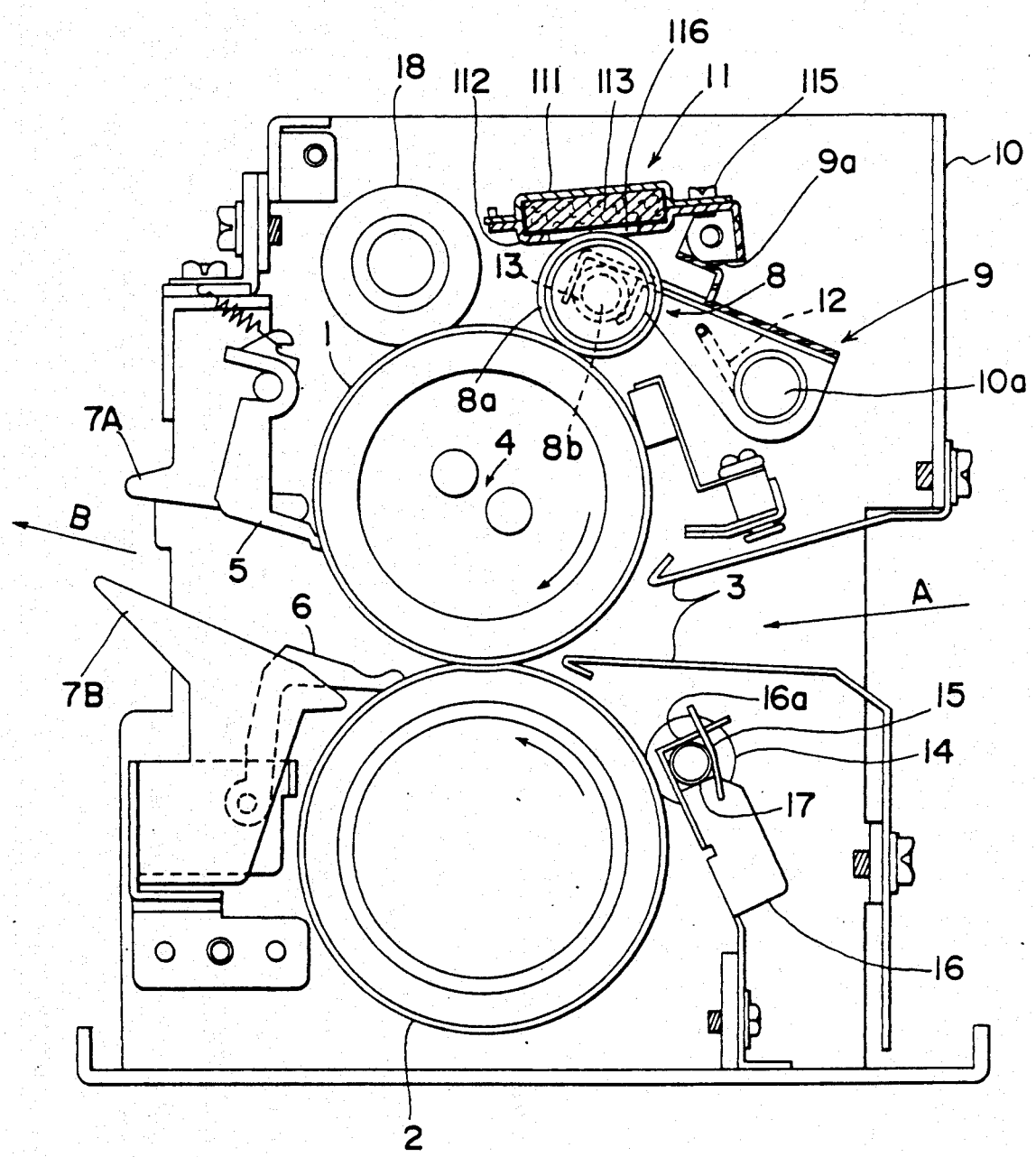
FIG. 1 is a cross section showing the construction of a fixing apparatus as one embodiment of this invention.

FIG. 1 is a cross section showing the construction of the fixing apparatus equipped with an oil application apparatus according to this invention.

A heat roller 1 is forcibly rotated clockwise at a fixed position by a drive equipment, not shown, installed in the copying machine body which incorporates the fixing apparatus.

A heat roller 1 is 60mm in outer diameter and its revolution speed is 91 rpm, which is equal to the line speed of about 290mm/sec.

A press roller 2 is pressed against the heat roller 1 immediately from below the latter and driven by it to rotate counterclockwise. The recording paper with a toner image transferred onto the upper side thereof is fed in the direction of arrow A through front guide plates 3 toward the pressure contact portion of these rollers. The recording paper is clamped by the rollers and carried to the left. During the process, the toner image on the upper surface of the recording paper is fused by heat of a group of heaters 4 incorporated in the heat roller 1. The surface temperature of the heat roller 1 is controlled at 200° C. but may vary in the range of 185 to 200° C. depending on the ambient and operating conditions.

The recording paper with the toner image fixed is taken out of the pressure contact portion of the rollers and, after the toner image is cooled and solidifies, it is peeled off the roller surface by separating claws 5 and 6. The separated paper is further carried in the direction of arrow B and discharged through rear guide members 7A and 7B out of the fixing apparatus body.

Designated by numeral 8 is an oil application roller that is pressed against the heat roller 1 and, as it is rotated by it, applies oil over the circumferential surface of the heat roller 1. The oil application roller 8 is a brush roller consisting of a pipe, which is 18mm in inner diameter, 21mm in outer diameter and 445mm in length, with aramid fibers (#20/20) attached to the circumferential surface of the pipe at the density of 1550 fibers/inch$^2$. A brush portion 8*a* has a fiber height of about 2.5mm and thus the outer diameter of the brush portion 8*a* is 26mm. The brush portion 8*a* is impregnated with 10 grams of silicone oil SH200 (Toray make) whose dynamic viscosity is 15,000 to 100,000 cst, preferably 20,000 to 60,000 cst. A ring-shaped pressure contact member 8*c* (FIG. 2) made of resilient heat-resistant silicon rubber is fitted to each end of the oil application roller 8 so that each pressure contact member 8*c* is in pressure contact with the heat roller 1. The surface of the pressure contact member 8*c* is machined rough to provide a large friction. In this embodiment the pressure contact member 8*c* at each end of the oil application roller 8 has a width of 7mm, and the brush portion 8*a* has a length of 432mm, a slightly longer than the A3 longer side of 420mm. The outer diameter of the pressure contact member 8*c* is slightly smaller than that of the brush portion 8*a*, which is 26mm, so that the pressure contact member 8*c* comes into pressure contact with the circumferential surface of the heat roller 1 after the brush portion 8*a* is pressed against the circumferential surface of the heat roller 1 to form a nip. The oil application roller 8 is strongly pressed against the heat roller 1 by its own weight and a spring 12 described later so that it is rotated by the heat roller 1. The rotation of the oil application roller 8 is made more reliable by the pressure contact member 8*c*. As the heat roller 1 rotates at the linear speed of 250 to 300mm/sec, the oil application roller 8 driven by the heat roller 1 also rotates at the same linear speed.

The oil application roller 8 has a rotating shaft 8*b* projecting from the center at each end, through which the roller 8 is rotatably supported on a supporting member 9 described later.

Figure 2:
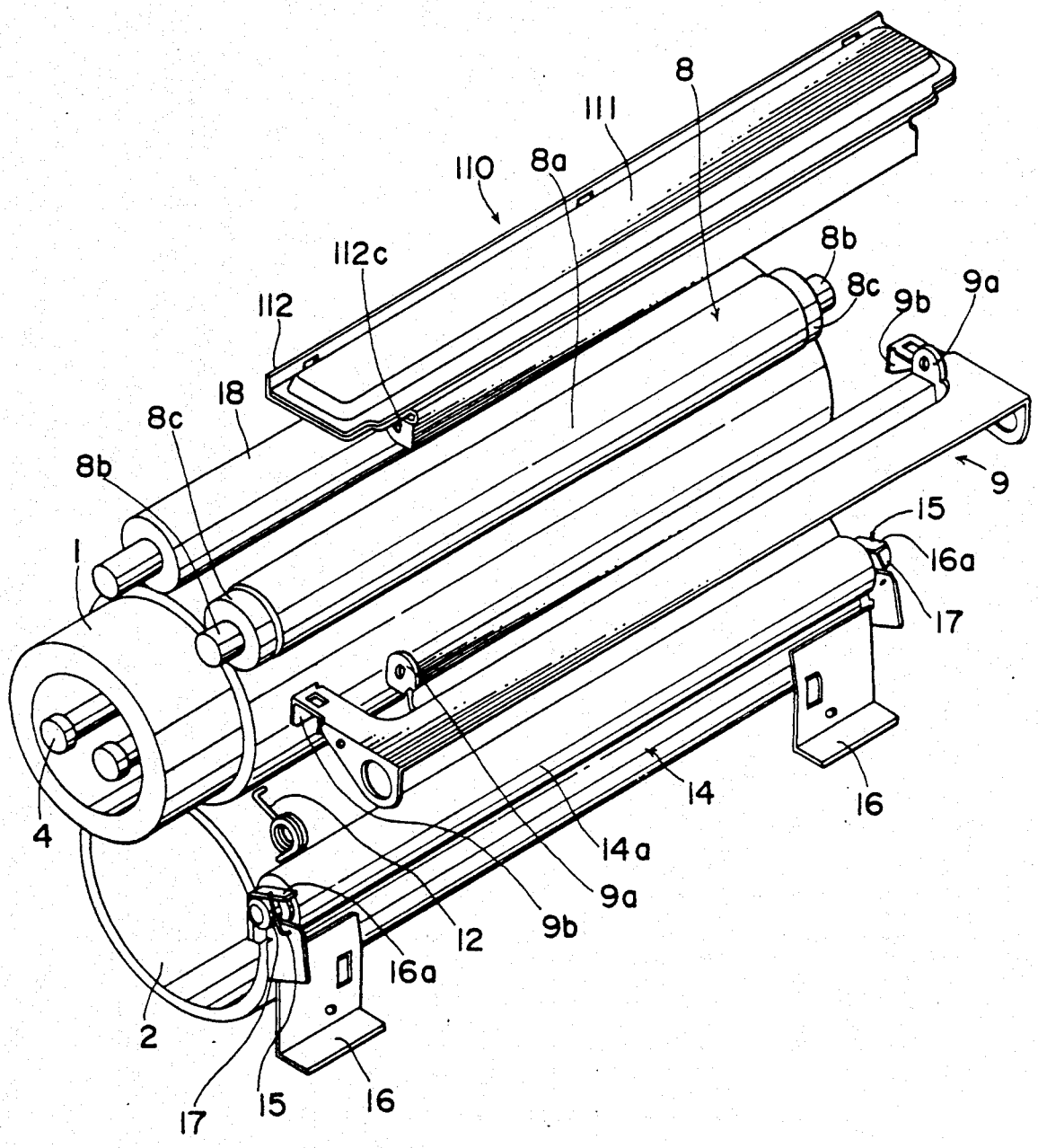
FIG. 2 is an exploded perspective view of an essential part of the fixing apparatus of FIG. 1.

Denoted by numeral 9 is the supporting member which is oscillatably supported on shafts 10*a* that project inwardly from the side walls of a fixing apparatus body 10. The supporting member 9 rotatably supports the oil application roller 8. As shown in FIG. 2, the supporting member 9 is a holder for the oil application roller 8 and is formed into an almost U shape and urged to turn clockwise by a spring 12. On the upper part of the supporting member 9 is formed an angled shaft support 9*a* which oscillatably supports the oil supply means 11 described later. The rotating shaft 8*b* of the oil application roller 8 is supported, through a bearing member 13, by a U-shaped support portion 9*b* formed at the front end of the supporting member 9 near the circumferential surface of the heat roller 1.

Figure 3:
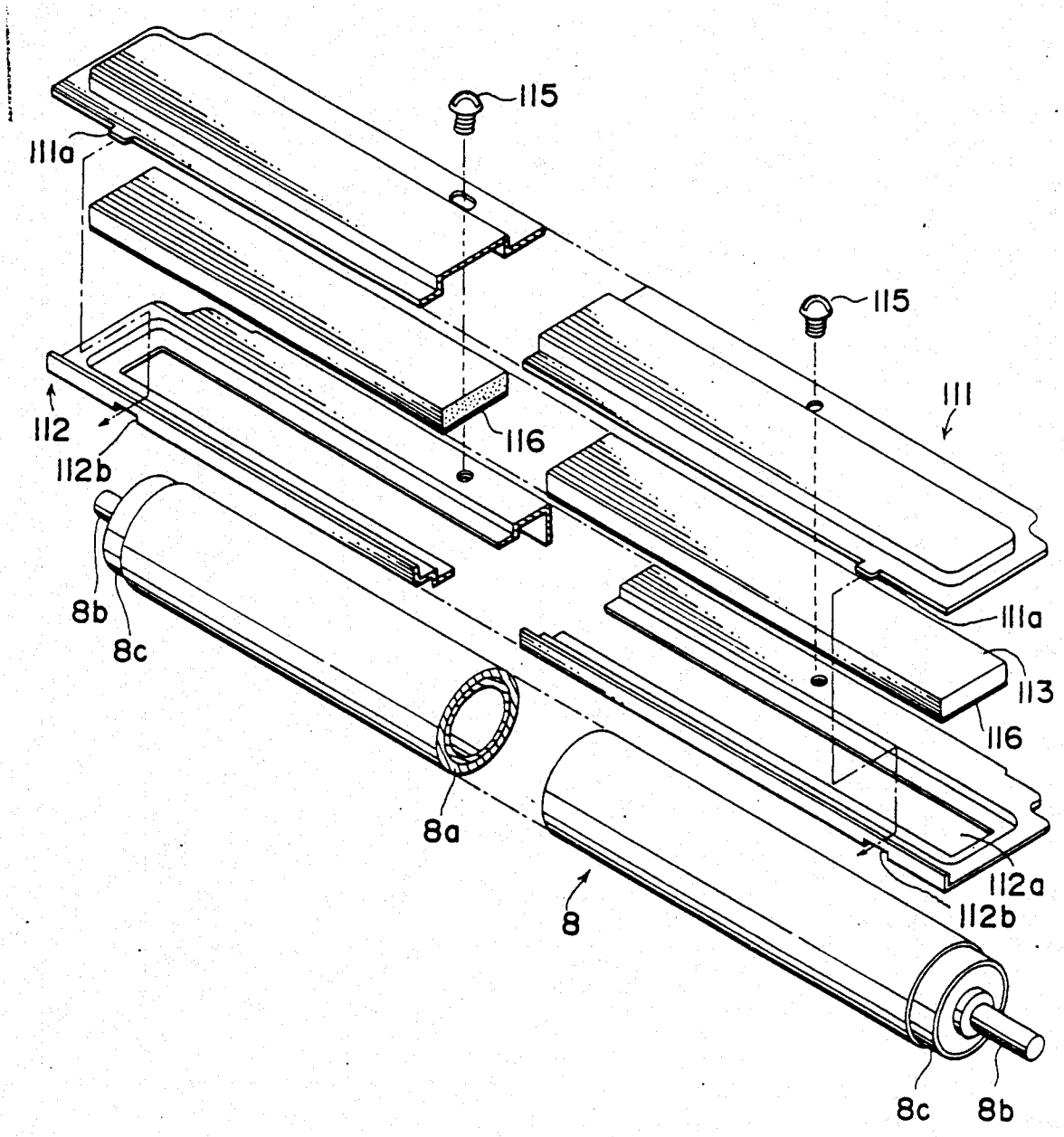
FIG. 3 is an exploded perspective view of an oil supply means of this invention.

Designated by numeral 11 is the oil supply means which continuously supplies oil to the oil application roller 8, as indicated in FIGS. 1 through 3. The oil supply means 11 consists of a holder frame 110 shaped like a long box made up of an upper case 111 and a lower case 112 and an oil-impregnated pad 113 contained in the hollow portion in the cases 111, 112. The upper case 111 has a plurality of projections 111*a* on one edge and the lower case 112 has engagement holes 112*b* into which the projections 111*a* are inserted. The upper case 111 and the lower case 112 are held together by inserting the projections 111*a* into the engagement holes 112*b* and fastening these cases by screws 115 to form the holder frame 110, as shown in FIG. 3. The lower case 112 has a long slot 112*a* cut in the bottom. The long slot 112*a* is nearly equal in the longitudinal length to the brush portion 8*a* . The lower case 112 has a pair of angled oscillation fulcra 112*c* , which are oscillatably supported on the shaft supports 9*a* of the supporting member 9 through shafts such as screws so that the holder frame 110 can move counterclockwise by its own weight, bringing the oil-impregnated pad 113 into sliding contact with the circumferential surface of the oil application roller 8 through the long slot 112*l*.

The oil-impregnated pad 113 is made of felt-like heat-resistant fiber layers, such as aramid fibers and polyester fibers—Vilene HP—55H (Nippon Vilene make)—and formed into a rectangular parallelepiped. The pad 113 is placed in sliding contact with the oil application roller 8 to supply oil to it. The oil-impregnated pad 113 has a piece of heat-resistant non-woven fabric of polyimide fibers, Vilene JH-1015CT (Nippon Vilene make) 116.

0.18mm in thickness, securely attached to the sliding contact surface. Through the heat-resistant non-woven fabric 116 oil is transferred from the oil-impregnated pad 113 to the oil application roller 8. When the thickness of the heat-resistant non-woven fabric 116 is less than 0.05mm, its shearing strength becomes smaller than 9kg/15mm and thus the non-woven fabric is not suitable for use. On the other hand, when the thickness is greater than 0.2mm, permeation of oil is not good. thus, the heat-resistant non-woven fabric 116 preferably has the thickness of between 0.05mm and 0.2mm.

The oil-impregnated roller 8, as mentioned before, is impregnated with 10 grams of silicone oil SH200 (Toray make) with dynamic viscosity of 15,000 to 100,000 cst. It is desired that the oil-impregnated pad 113 be impregnated with 40 to 60, preferably 50 grams of silicone oil SH200 (Toray make) with dynamic viscosity of 1,000 to 10,000, preferably 5,000 to 10,000 cst. The oil application roller 8 is in direct contact with the heat roller 1 so that it is heated by the heat roller 1. As the oil application roller 8 is heated, the dynamic viscosity of the oil impregnated in the roller 8 decreases. For this reason, oil with high dynamic viscosity is chosen for use on the oil application roller 8. Experiments have found it desirable that the ratio between the dynamic viscosity $\nu 2$ of oil impregnated in the pad 113 and the dynamic viscosity $\nu 1$ of oil impregnated in the oil application roller 8 be set at $$\nu 2:\nu 1 = 1:3 \text{ to } 30$$

According to the experiments, with the dynamic viscosity $\nu 1$ of oil impregnated in the oil application roller 8 fixed at 30,000 cst, when the dynamic viscosity $\nu 2$ of oil in the pad 113 becomes higher than 10,000 cst, the oil seeping speed from the pad 113 becomes slow. This means that when the ambient temperature is low or when the equipment has just started, there may be variations in the oil application performance. On the other hand, when the dynamic viscosity $\nu 2$ becomes lower than 1000 cst, the oil seeping speed on the pad 113 becomes high. That is, when the ambient temperature is high or when the equipment is running for some time, excess oil may be applied.

In case that oil of high dynamic viscosity is impregnated into the oil application roller 8, the amount of oil applied on the heat roller 1 becomes relatively large in the initial state.

However, the dynamic viscosity of oil to be applied is 15,000 to 100,000 cst, so that the application amount of oil is limited under a level where the transfer paper is soiled with oil. According to the reduction in amount of oil on the oil application roller 8 an amount of oil to be transferred from the oil-impregnated pad 113 to the oil application roller 8 increases and reaches to a steady level, so that a constant amount of oil can be applied on the transfer paper stably from the oil application roller 8 through the heat roller 1. It is considered that the amount of oil applied on the transfer paper is nearly equal to that transferred from the oil-impregnated pad 113 to the oil application roller 8.

Figure 4:
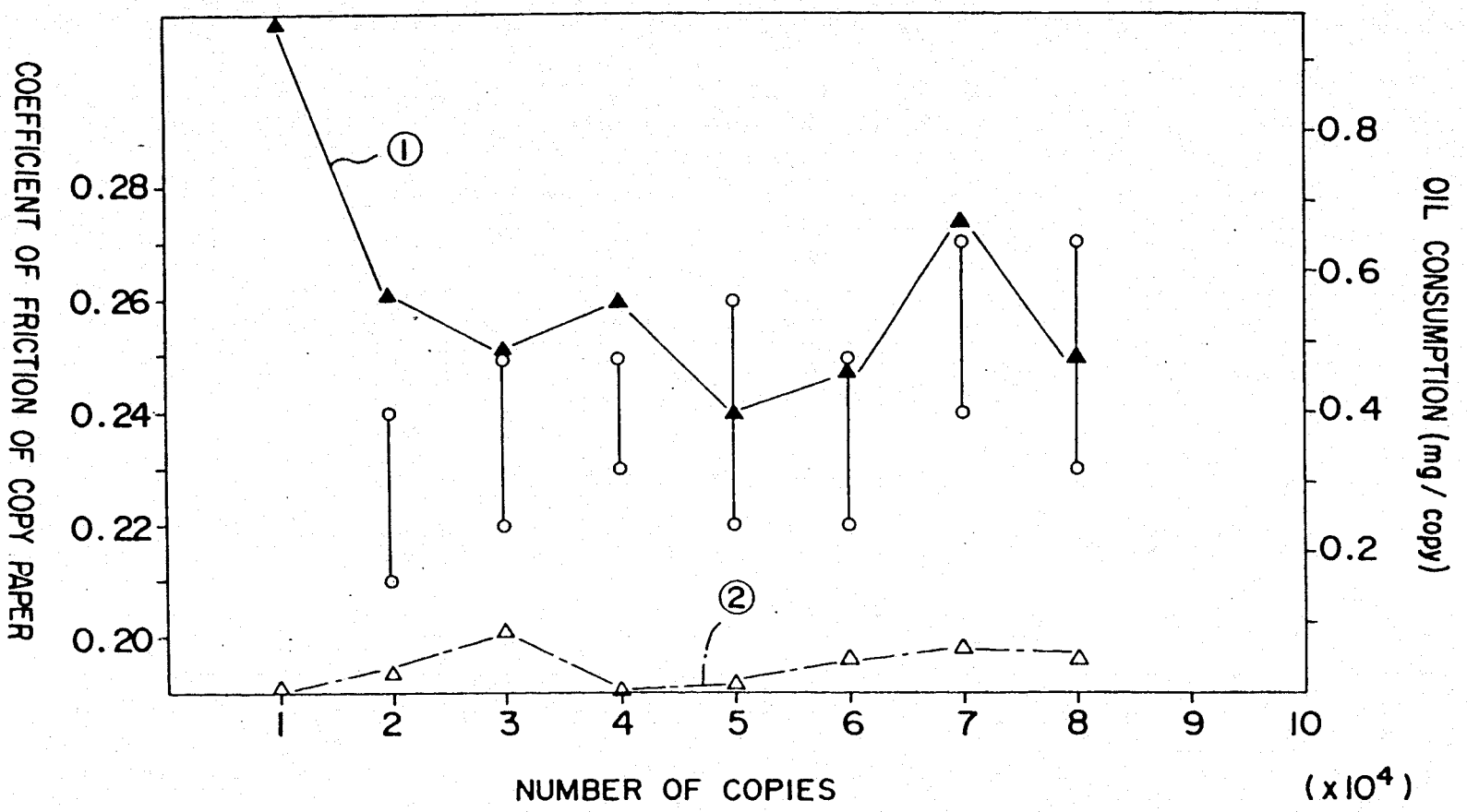
FIG. 4 is a characteristic diagram showing the relationship between the number of copies made and oil consumption.

FIG. 4 is a characteristic diagram showing the relationship between the number of copies made and the oil consumption, with the horizontal axis representing the number of copies and the vertical axis representing the amount of remaining oil. The line 1 is a characteristic line showing the amount of oil remaining in the pad 113 (or oil consumption) and the line 2 indicates the amount of oil remaining on the oil application roller 8 (or oil consumption).

As can be seen from FIG. 4, the oil consumption in the pad 113 is almost proportional to the number of copies. According to the characteristic line 1, it is calculated that the oil consumption for each copy is 0.3 to 0.6 mg. The coefficient of friction between the sheets of recording paper which have their toner images fixed under such an oil consumption so 0.22 to 0.27, as indicated by the vertical lines for each of the copy numbers of FIG. 4. Considering the fact that the friction coefficient between the recording paper sheets is 0.28 to 0.29 when toner images are fixed by conventional techniques, it is apparant that the fixing apparatus of this invention reduces the friction coefficient.

Various paper sizes were used in the experiments, and for precise comparison the amount of oil applied over unit area of recording paper, i.e., 10cm square, was determined. This is calculated to be $$3.5\times 10^{-2}\text{mg}/100\text{cm}^2 \text{ to } 0.11\text{mg}/100\text{cm}^2$$

With the recording paper thus processed, which has small friction coefficients, the toner image will not come off or peel off due to excess frictions when the recording paper is used as the second document, which is stacked and circulated for further processing, or when it is stacked and inverted for two-side copying.

When the amount of oil applied to the 10cm-square unit area of the recording paper is less than $3.5\times 10^{-2}$mg/100cm$^2$, the paper friction coefficient becomes higher than 0.27. As a result, the toner image will come off from excess friction. When the oil application over the 10cm-square unit area of the recording paper exceeds 0.11mg/100cm$^2$, the excess oil will smear the recording paper.

Denoted by numeral 14 is an oil absorbing roller which, as shown in FIGS. 1 and 2, absorbs oil adhering to the circumferential surface of the press roller 2 s it is rotated by the press roller 2 with which it is in pressure contact. The oil absorbing roller 14 consists of a pipe 12mm in inner diameter, 15mm in outer diameter, and 445mm in length, with a felt-like heat-resistant fiber layer 14*a* about 2mm thick bonded to the outer circumference thereof. The oil absorbing roller 14 is rotatably supported on a pair of stationary plates 16. The stationary plates 16 each have an angled bearing support 16*a*, in which a bearing 17 for rotatably supporting the oil absorbing roller 14 is installed. The bearing 17 is fixed in position in the bearing support 16*a* of the stationary plate 16 by a nearly L-shaped push spring 15. Each stationary plate 16 is securely positioned so that the oil absorbing roller 14 supported on the bearings 17 is in tight pressure contact with the press roller 2. Since the oil absorbing roller 14 acts, through the bearings 17, to push back the push springs 15, the force acting on the oil absorbing roller 14 is only the push by the push springs 15 which push the bearings 17 from behind.

Reference numeral 18 (FIG. 1) represents a foamed silicon rubber roller with no oil impregnated, which is pressed against the circumferential surface of the heat roller 1 to either drive or be driven by it. The roller 18 is a cleaning roller to absorb and remove toner etc. adhering to the circumferential surface of the heat roller 1 as it rotates.

Above is the construction of the embodiment of this invention, and now its action will be explained.

As the equipment goes to a standby state, the group of heaters 4 are energized and at the same time the heat roller 1 rotates, driving the press roller 2. As the heat roller 1 turns, the brush portion 8*a* and the pressure contact member 8*c* at each end of the oil application roller 8, which are in pressure contact with the heat roller 1, are rotated by the hat roller 1 through friction. The oil application roller 8 continuously supplied with oil from the pad 113 of the oil supply means 11 applies silicone oil to the circumferential surface of the heat roller 1. As a result, the silicone oil is spread thinly and uniformly over the surface of the recording paper, on which the toner image has been fused and fixed by the heat of the surface of the heat roller 1.

Therefore, when the recording paper with toner images fixed on one side is stacked as the second document on the document stacker for further circulation processing or when it is stacked on the intermediate stacker for inversion and copying on the other side, nd if the toner image surface of the lowermost sheet of the stacked paper is strongly pressed against the second lowest sheet by the bottom sheet feeding mechanism, the bottom sheet can be smoothly separated without the toner image being removed by excess friction because the friction coefficient between them is reduced by the silicone oil. Furthermore, since the oil on the press roller 2 is absorb by the oil absorbing roller 14 as the latter is rotated by the press roller 2 with which it is in pressure contact, the recording paper is not smeared by excess oil.

According to this invention, the oil application apparatus equipped with an oil supply means is characterized by the construction in which the oil application roller is pressed against and rotated by the heat roller of the heating and fixing apparatus to apply oil to the heat roller surface, and in which a resilient member impregnated with oil is pressed against the oil application roller. The oil application roller applies oil to the surface of recording paper on which the toner image has just been fixed. The amount of oil applied to the recording paper surface per unit area of 10cm-square is set at $3.5\times10^{-2}$mg/100cm$^2$ to 0.11 mg/100cm$^2$. Because of the above construction, when the fixed recording paper is to be used as the second document or when it is to be inverted for both-side copying, the lowermost sheet of the stacked recording paper is separated and fed out. At this time since the friction coefficient between the recording paper sheets are reduced by oil the toner image will not come off or be smeared but maintain a good image quality.

Moreover, in the fixing apparatus of this invention since the dynamic viscosity of oil soaked in the pad is set at an appropriate value, oil is reliably and uniformly applied over the recording paper surface onto which the toner image is already transferred and fixed by the heating and fixing apparatus. This results in a reduction in the friction coefficient between the fixed copy sheets when they are used as the second document. The second document can be carried through a circulation type document feeder device any number of times without being smeared, and it can maintain a good image quality.

What is claimed is:

1. In a fixing apparatus wherein a toner image is formed on a transfer medium by passing the transfer medium between a heat roller and a press roller, each of the rollers rotating while in pressure contact with each other, comprising:

an oil application roller disposed in pressure contact and driven by the heat roller, the oil application roller including a circumferential surface, and having a layer of heat resistant fibers impregnated with a first oil having a dynamic viscosity $\nu1$ on the circumferential surface thereof; and oil supply means impregnated with a second oil having a viscosity $\nu2$, for supplying oil to the oil application roller, wherein $\nu1>\nu2$, the oil supply means including a non-woven cloth comprising a pressure contact surface having a thickness in the range of 0.05mm to 0.2mm, and an oil-impregnated member being pressed against the oil application roller through the pressure contact surface of the non-woven cloth for transferring oil to the oil application roller, and for continuously supplying the oil application roller with oil from the oil supply means and applying oil to the circumferential surface of the heat roller during rotation thereof, wherein the amount of oil applied to the transfer medium is in the range of $3.5\times10^{-2}$mg/100cm$^2$to 0.11mg/100cm$^2$ and the amount of oil applied to the transfer medium is substantially equal to the amount of oil transferred from the oil impregnated member to the oil application roller.

2. In a fixing apparatus wherein a toner image is formed on a transfer medium by passing the transfer medium between a heat roller and a press roller, each of the rollers rotating while in pressure contact with each other, comprising:

an oil application roller having a layer of heat-resistant fibers impregnated with a first oil having a dynamic viscosity of $\nu1$; and oil supply means including a fiber member impregnated with a second oil having a dynamic viscosity of $\nu2$, wherein $\nu2$ is in the range of 1000 cst to 10,000 cst, the oil-impregnated fiber member being pressed against the oil application roller for transferring oil to the oil application roller, wherein the amount of oil applied to the transfer medium is in the range of $3.5\times10^{-2}$mg/100cm$^2$ to 0.11mg/100cm$^2$ and the ratio of dynamic viscosities of the first and second oils is in the range of:

$$\nu2:\nu1=1:3 \text{ to } 30.$$

3. In a copying machine including a fixing apparatus and a feeding apparatus, wherein a toner image is formed on a transfer medium comprising a plurality of sheets by the fixing apparatus, the sheets being stacked on a stacker and the successive lowermost sheet on the stacker being fed by the feeding apparatus, comprising:

oil application means for applying oil to a heat roller of the fixing apparatus and then to the transfer medium, the oil application means including an oil application roller disposed in pressure contact and driven by the heat roller, the oil application roller including a circumferential surface, and having a layer of heat resistant fibers on the circumferential surface thereof, the oil application roller fibers being impregnated with a first oil having a dynamic viscosity $\nu1$ , and oil supply means impregnated with a second oil having a dynamic viscosity $\nu2$ for supplying oil to the oil application roller, wherein $\nu1>\nu2$ and the amount of oil applied to each sheet of the transfer medium is substantially equal to $3.5\times10^{-2}$mg/100cm$^2$ to 0.11mg/ 100cm$^2$.

4. The fixing apparatus of claim 1 wherein the dynamic viscosity $\nu 1$ of the first oil is in the range of 15,000 cst to 100,000 cst.

5. The fixing apparatus of claim 1 wherein the dynamic viscosity $\nu 2$ of the second oil is in the range of 1,000 cst to 10,000 cst.

6. The fixing apparatus of claim 1 wherein the ratio of dynamic viscosities of the first and second oils is in the range of $\nu 2:\nu 1 = 1:3$ to 30.

7. The fixing apparatus of claim 3 wherein the dynamic viscosity $\nu 2$ of the second oil is in the range of 1,000 cst to 10,000 cst.

8. The fixing apparatus of claim 3 wherein the ratio of dynamic viscosities of the first and second oils is in the range of $\nu 2:\nu 1 = 3$ to 30.

* * * * *